United States Patent [19]

Brown

[11] Patent Number: 5,059,938

[45] Date of Patent: Oct. 22, 1991

[54] WIRE WOUND IGNITION CABLE AND METHOD FOR MAKING SAME

[75] Inventor: Karl M. Brown, Port Huron, Mich.

[73] Assignee: Prestolite Wire Corporation, Farmington Hills, Mich.

[21] Appl. No.: 509,145

[22] Filed: Apr. 16, 1990

[51] Int. Cl.[5] ..... H01C 10/08; H01C 7/00

[52] U.S. Cl. ..... 338/66; 338/214

[58] Field of Search ..... 338/66, 214; 174/102 SC, 120 SC

[56] References Cited

U.S. PATENT DOCUMENTS 4,700,171 10/1987 Coffey et al. ..... 338/214

4,970,488 11/1990 Horiike et al. ..... 338/214

*Primary Examiner*—Marvin M. Lateef

*Attorney, Agent, or Firm*—Remy J. VanOphem

[57] ABSTRACT

An ignition cable having a resistance wire helically wound around a strength member to form a conductive core. A very thin adhesive layer is applied over the conductive core and is overlaid with a semi-conductive layer of a cross-linked thermosetting material. The cross-linked thermosetting material is extruded over the adhesive layer to form a smooth surface. A layer of insulating material and a protective jacket are applied over the insulating layer. A braid may be added intermediate the insulating layer and the jacket to increase the mechanical strength of the ignition cable.

24 Claims, 1 Drawing Sheet

WIRE WOUND IGNITION CABLE AND METHOD FOR MAKING SAME

BACKGROUND OF THE INVENTION

1. Field of the Invention

The invention is related to electrical cables and in particular to a wire wound core ignition cable for internal combustion engines.

2. Description of the Prior Art

Ignition cables having a wire wound core provide a means for accurately and reliably controlling the resistivity of a finished product. The current ignition cables having a wire wound conductive core are difficult to strip to make electrical connection between the wire and a terminal. Frequently the wire, because it is not protected, is pulled out of the end of the cable during the stripping operation resulting in the formation of an unwanted and undesirable wire "tail". If this "tail" is not properly trimmed prior to attachement of the terminal, it can lead to premature dielectric failure of the terminal assembly or cause arcing between the tail and a ground plane.

A typical example of such a wire wound cable is taught by Miyamoto et al in U.S. Pat. No. 4,435,692 and Coffey et al in U.S. Pat. No. 4,700,171. Miyamoto et al teach a wire wound ignition cable in which the resistance wire is wound over a ferrite core. The resistance wire and ferrite core are coated by an extruded layer of a blend of polyethylene and ethylene propylene diene. Coffey et al disclose an ignition cable comparable to that taught by Miyamoto in which a core is formed by dip coating a glass fiber strength member with an insulating layer containing magnetic particles such as iron oxide. The core is then helically wrapped with a resistance wire. The resistance wire is then dip coated with a semi-conductive thermoplastic polymer. The semi-conductive thermoplastic polymer contains carbon particles and release agents which allow subsequently applied insulating layers to be stripped cleanly.

The problem with the ignition cable taught by Coffey et al is that the semi-conductive thermoplastic is unstable at relatively low temperatures. Therefore, the temperature range of the ignition cable taught by Coffey is limited. The invention is a solution to the temperature stability of the ignition cable which allows it to be used at temperatures up to 500° F.

SUMMARY OF THE INVENTION

The invention is an ignition cable having a resistance wire helically wound around a strength member to form a conductive core. An adhesive layer is applied over the conductive core and a semi-conductive layer of a cross-linked thermosetting material is extruded over the adhesive layer to form a composite conductive core. A layer of insulating material and a protective jacket are applied over the composite conductive core.

In the preferred embodiment, the extruded semi-conductive layer is made from a conductive silicone manufactured by DOW-STI of Kenville, Ind. which has suspended carbon black particles to render it semi-conductive.

The object of the invention is a low resistance ignition cable having low electrical tolerances and high temperature capabilities.

Another object of the invention is a wire wound ignition cable that is readily strippable.

Another object of the invention is to bond the wires to the strength member to keep it from unraveling.

Still another object of the invention is an ignition cable which is stable up to 500° F.

A yet further object of the invention is to increase the temperature stability by using an extruded layer of a semi-conductive cross linked thermosetting material over the helically wound wire.

A final object of the invention is to increase the strippability of the conductive core by extruding the semi-conductive layer over the wire wound conductive core to generate a smooth interface surface between the semi-conductive layer and the overlaying insulating layer.

These and other objects, features and advantages of the invention will become more apparent from a reading of the specification in conjunction with the drawings.

DETAILED DESCRIPTION OF THE PREFERRED EMBODIMENT

Figure 1:
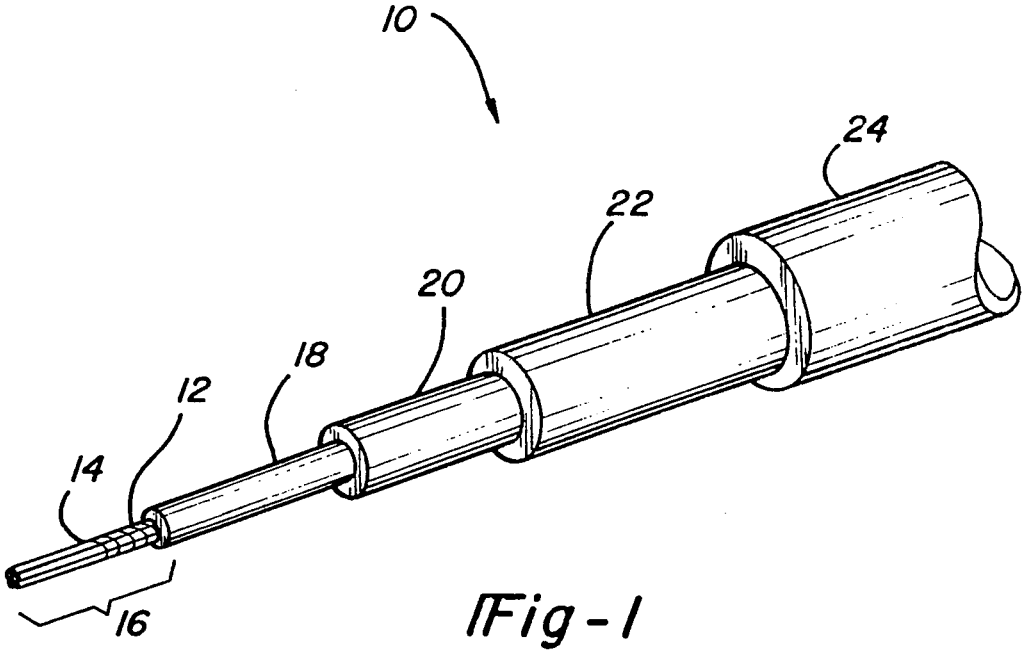
FIG. 1 is a perspective view showing the construction details of a first embodiment of the ignition cable of the present invention.

FIG. 1 shows the details of a wire wound ignition cable 10 according to the present invention. The wire wound ignition cable 10 has a resistance wire 12 helically wound around a strength member 14 to form a conductive core 16. The resistance wire preferably has a resistance ranging from 1 to 200 ohms per inch and it may be made from a metal alloy or other suitable material. The number of turns per inch of the resistance wire 12 and its resistance determines the resistivity of the conductive core 16. The strength member may be a single strand of a non-conductive fiber or a roving made from a plurality of non-conductive fibers. The strength member 14 may be rendered conductive by coating the single strand with a conductive paint or material such as a latex binder impregnated with suspended graphite or carbon particles. In the case of a roving, the roving may be impregnated with a conductive paint or material as discussed above.

The conductive core 16 is coated with a very thin layer of adhesive material 18, such as CHEMLOK® AP-133, manufactured by Lord Corporation of Erie, Pa. to facilitate adhesion of an overlaying semi-conductive layer 20. This adhesive layer is less than 0.0005 thick and has minimal effect on the conduction between the wire and the semi-conductive layer 20. The semi-conductive layer 20 is made from a cross linked thermosetting material such as a conductive silicone manufactured by DOW-STI of Kenville, Ind. The semi-conductive material has a resistivity of 1 to 40 ohm centimeters. The semi-conductive layer is preferably extruded over the layer of adhesive material so that it has a smooth external surface. The advantage of the semi-conductive layer being made from a cross-linkable thermosetting material over a thermoplastic material plastic as taught by the prior art is that it is thermodynamically more stable particularly at temperatures up to 500° F.

The cross-sectional area and the resistivity of the semi-conductive layer 20 are selected so that the resistivity of the composite conductive core which includes the semi-conductive layer 20 and the conductive core 16 is not changed by more than ten percent (10%) as a result of the application of the semi-conductive layer 20.

An insulating layer 22 is disposed over the semi-conductive layer 20 which in turn is coated with a protective jacket 24. The insulating layer is made from an elastomer, a cross linked polyolefin, or other insulating material commonly used in the manufacture of ignition cables. The protective jacket 24 may be made from polyolefin, silicone rubber or other similar materials.

Figure 2:
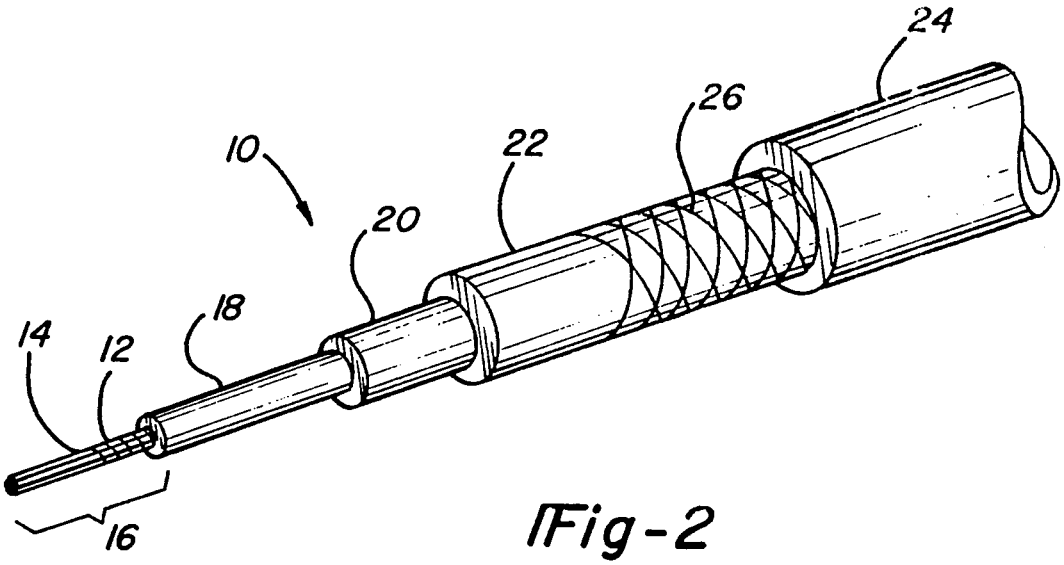
FIG. 2 is a perspective view showing the construction details of a second embodiment of the ignition cable.

As shown in FIG. 2, a glass braid 26 may be applied over the insulating layer 22 to increase the mechanical strength of the ignition cable. The wire wound conductive core 16 permits a desired resistance for the ignition cable to be accurately obtained. By altering the number of turns per inch of the resistance wire during fabrication, the resistance of the ignition cable may be tailored to a customer's specific requirements. The addition of the semi-conductive layer 20 over the conductive core 16 prevents the wire from being damaged during subsequent stripping and termination operations associated with adding of terminals to the ends of the ignition cable. The extruded semi-conductive layer 20 also provides a smooth interface between the conductor and the insulating layer 22 which enhances the dielectric strength of the ignition cable.

It is recognized that those skilled in the art may make changes in the structure and the materials used in the fabrication of the ignition cable within the scope of the invention as described herein and set forth in the appended claims.

What is claimed is:

1. An ignition cable comprising:

a longitudinal strength member;

a wire helically wound around said longitudinal strength member to produce a conductive core having a predetermined resistivity;

a thin layer of adhesive material circumjacent said conductive core;

a layer of cross-linkable semi-conductive thermosetting material extruded over said thin layer of adhesive material and said conductive core to produce a composite core, said thin layer of adhesive material promoting a strippable bond between said cross-linkable semi-conductive thermosetting material and said conductive core;

a layer of insulating material overlaying said composite core; and a protective jacket overlaying said layer of insulating material.

2. The ignition cable of claim 1 further comprising a glass braid disposed between said layer of insulating material and said protective jacket.

3. The ignition cable of claim 1 wherein said longitudinal strength member is a plurality of non-conductive fibers.

4. The ignition cable of claim 3 wherein said plurality of non-conductive fibers is coated with a conductive material.

5. The ignition cable of claim 3 wherein said plurality of non-conductive fibers is impregnated with a conductive material.

6. The ignition cable of claim 1 wherein said wire is a metal.

7. The ignition cable of claim 1 wherein said wire is an alloy.

8. The ignition cable of claim 1 wherein said wire has a resistance ranging between 1 and 200 ohms per inch.

9. The ignition cable of claim 3 wherein said wire is helically wound around said longitudinal strength member at a rate between 1 to 500 turns per inch.

10. The ignition cable of claim 9 wherein said resistance of said wire and the number of turns per inch of said wire about said longitudinal strength member are selected to produce said predetermined resistivity of said conductive core.

11. The ignition cable of claim 1 wherein said semi-conductive material has a resistivity of 1 to 40 ohm centimeters.

12. The ignition cable of claim 11 wherein said resistivity of said semi-conductive material and the thickness of said layer of semi-conductive material are selected to limit the change in the resistivity of said composite core to a value no greater than $\pm 10\%$ of said predetermined resistivity.

13. The ignition cable of claim 1 wherein the external surface of said extruded layer of semi-conductive material provides a smooth interface with said layer of insulating material.

14. A wire wound ignition cable comprising:

a plurality of nonmetallic fibers forming a longitudinal strength member;

a wire having a resistance of 1 to 200 ohms per inch helically wound around said longitudinal strength member to form a conductive core having a first resistivity;

a thin adhesive layer applied on said conductive core;

a layer of cross-linkable semi-conductive thermosetting material extruded onto said thin adhesive layer to form a composite conductive core having a resistivity within $\pm 10\%$ of said first resistivity, said thin adhesive layer promoting a strippable bond between said cross-linkable semi-conductive thermosetting material and said conductive core;

a layer of insulating material disposed on the surface of said composite conductive core; and a protective jacket disposed on the surface of said layer of insulating material.

15. The wire wound ignition cable of claim 14 wherein said nonmetallic fibers are non-conductive fibers.

16. The wire wound ignition cable of claim 14 wherein said plurality of nonmetallic fibers are a roving of non-conductive fibers coated with a conductive material.

17. The wire wound ignition cable of claim 14 wherein said plurality of nonmetallic fibers are a roving of non-conductive fibers impregnated with a conductive material.

18. The wire wound ignition cable of claim 14 wherein said cross-link semi-conductive thermosetting material has a resistivity of 1 to 40 ohm centimeters.

19. The wire wound ignition cable of claim 14 wherein the external surface of said layer of cross-linkable semi-conductive thermosetting material is smooth.

20. The wire wound ignition cable of claim 14 further comprising a glass braid disposed between said layer of insulating material and said protective jacket.

21. A method of making an ignition cable comprising the steps of:

winding a wire around a longitudinal strength member to form a conductive core having a first resistivity;

applying a thin adhesive layer over said conductive core;

extruding a layer of semi-conductive material onto said thin adhesive layer to form a composite conductive core having a second resistivity, said second resistivity being equal to said first resistivity within ±10%;

coating said composite conductive core with a layer of insulating material; and coating said layer of insulating material with a protective jacket.

22. The method of claim 21 further comprising the step of coating said longitudinal strength member with a conductive material.

23. The method of claim 21 wherein said longitudinal strength member comprises a plurality of non-conductive fibers, said method further comprising the step of impregnating said plurality of non-conductive fibers with a conductive material.

24. The method of claim 21 further comprising the step of braiding a layer of non-conductive fibers over said layer of insulating material prior to said step of coating said layer of insulating material with a protective jacket.

* * * * *

UNITED STATES PATENT AND TRADEMARK OFFICE

CERTIFICATE OF CORRECTION

PATENT NO. : 5,059,938

DATED : October 22, 1991

INVENTOR(S) : Karl M. Brown

It is certified that error appears in the above-identified patent and that said Letters Patent is hereby corrected as shown below:

Column 1, line 20, delete "attachement" and insert ---- attachment ----.

Column 2, line 63, delete "plastic".

Column 4, line 54, delete "cross-link" and insert ---- cross-linkable ----.

Column 5, line 1, after "of" insert ---- cross-linkable ----; same line, before "material" insert ---- thermosetting ----.

Signed and Sealed this

Sixth Day of April, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,059,938

DATED : October 22, 1991

INVENTOR(S) : Karl M. Brown

It is certified that error appears in the above-identified patent and that said Letters Patent is hereby corrected as shown below:

Col. 2, line 38, delete "resistance determines the resistivity" and insert ---- resistivity determines the resistance ----.

Col. 2, line 67, delete "resis" and insert ---- resistance ----.

Col. 2, line 68, delete "tivity".

Column 4, line 7, delete "resistivity" and insert ---- resistance ----

Signed and Sealed this

Twenty-fourth Day of May, 1994

Bruce Lehman

*Attest:*

BRUCE LEHMAN

*Attesting Officer*

*Commissioner of Patents and Trademarks*